US010236583B2

(12) United States Patent
Kuno

(10) Patent No.: US 10,236,583 B2
(45) Date of Patent: Mar. 19, 2019

(54) DIELECTRIC ANTENNA

(71) Applicant: CASIO COMPUTER CO., LTD., Shibuya-ku, Tokyo (JP)

(72) Inventor: Toshiya Kuno, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 45 days.

(21) Appl. No.: 15/188,916

(22) Filed: Jun. 21, 2016

(65) Prior Publication Data

US 2017/0062934 A1 Mar. 2, 2017

(30) Foreign Application Priority Data

Aug. 26, 2015 (JP) ..... 2015-166543

(51) Int. Cl.
*H01Q 1/12* (2006.01)
*H01Q 9/04* (2006.01)
*H01Q 1/38* (2006.01)

(52) U.S. Cl.
CPC ..... *H01Q 9/0407* (2013.01); *H01Q 1/38* (2013.01)

(58) Field of Classification Search
None
See application file for complete search history.

(56) References Cited

U.S. PATENT DOCUMENTS 6,686,406 B2 * 2/2004 Tomomatsu ..... C01G 29/00 343/785
7,884,764 B2 * 2/2011 Itsuji ..... H01Q 1/38 343/700 MS
7,961,148 B2 * 6/2011 Goldberger ..... H01L 25/165 343/700 MS
9,531,077 B1 * 12/2016 Weller ..... H01Q 1/38
2002/0041254 A1 * 4/2002 Nakano ..... H01Q 1/40 343/700 MS
2003/0080836 A1 * 5/2003 Nagaishi ..... H01L 23/552 333/247
2004/0095279 A1 * 5/2004 Shikata ..... H01Q 9/0407 343/700 MS
2004/0104847 A1 * 6/2004 Killen ..... H01Q 1/38 343/700 MS
2006/0249705 A1 * 11/2006 Wang ..... A61L 29/18 252/62.51 C (Continued)

FOREIGN PATENT DOCUMENTS

CN 1969016 A 5/2007
CN 101123327 A 2/2008

(Continued)

OTHER PUBLICATIONS

Chinese Office Action (and English language translation thereof) dated Aug. 29, 2018 issued in Chinese Application No. 201610547416.4.

*Primary Examiner* — Trinh Dinh
(74) *Attorney, Agent, or Firm* — Holtz, Holtz & Volek PC

(57) ABSTRACT

A dielectric antenna has high impact resistance and high receiving sensitivity. The dielectric antenna includes a dielectric member which includes a laminate of a flexible dielectric portion including dispersed dielectric ceramic particles and a substrate having higher hardness than the flexible dielectric portion, and electrode disposed on the dielectric member.

6 Claims, 5 Drawing Sheets

(56) References Cited

U.S. PATENT DOCUMENTS

| | | | | |
|---|---|---|---|---|
| 2007/0018901 | A1* | 1/2007 | Wang | H01Q 11/105 343/792.5 |
| 2007/0024508 | A1* | 2/2007 | Lee | H01Q 1/242 343/702 |
| 2009/0167614 | A1* | 7/2009 | Takaki | H01Q 1/243 343/702 |
| 2010/0117919 | A1* | 5/2010 | Mizuno | G06K 7/10346 343/846 |
| 2013/0181876 | A1* | 7/2013 | Miura | G06K 7/10316 343/788 |
| 2015/0349414 | A1* | 12/2015 | Tagi | G01S 7/03 343/872 |

FOREIGN PATENT DOCUMENTS

| | | | |
|---|---|---|---|
| CN | 103241964 | A | 8/2013 |
| CN | 104617385 | A | 5/2015 |
| JP | 2006164911 | A | 6/2006 |

* cited by examiner

DIELECTRIC ANTENNA

BACKGROUND OF THE INVENTION

1. Field of the Invention

The present invention relates to dielectric antennas.

2. Description of Related Art

In recent years, spread in use of various portable devices, such as wearable terminals, and significant development in wireless communication technology have increased the demand for compact high-performance antennas for the wireless communication. Dielectric antennas have been preferably used to meet the demand and various proposals have been made for relevant techniques.

For example, Patent Literature 1 (Japanese Unexamined Patent Application Publication No. 2006-164911) discloses a technique using a dielectric member composed of a flexible elastomer containing a dielectric ceramic material to achieve a high dielectric constant and high impact resistance of the dielectric member.

Unfortunately, the dielectric member composed of only a flexible elastomeric member has low resistance to deformation while having high impact resistance. Such a dielectric member having low deformation resistance is difficult to fix to a device body. In addition, the deformation of the dielectric member may cause a change in a resonant frequency, resulting in a fluctuation in receiving sensitivity.

SUMMARY OF THE INVENTION

The present invention provides a dielectric antenna having high impact resistance and high receiving sensitivity.

To solve the problem described above, there is provided a dielectric antenna, including: a dielectric member comprising a laminate of a flexible dielectric portion including dispersed dielectric ceramic particles and a substrate having higher hardness than the flexible dielectric portion; and electrode disposed on the dielectric member.

The present invention can provide a dielectric antenna having high impact resistance and high receiving sensitivity.

DETAILED DESCRIPTION OF THE PREFERRED EMBODIMENTS

Embodiments of a dielectric antenna according to the present invention will now be described with reference to the accompanying drawings. Although the embodiments described below have various limitations that are technically preferable in implementing the present invention, the scope of the present invention should not be limited to the following embodiments and illustrated examples.

First Embodiment

A first embodiment of the present invention will now be described.

Figure 1:
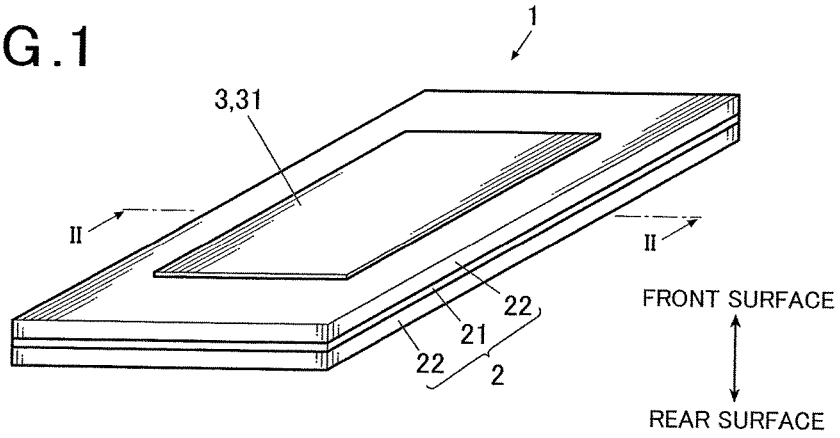
FIG. 1 is a front perspective view of a dielectric antenna of a first embodiment.
Figure 2:
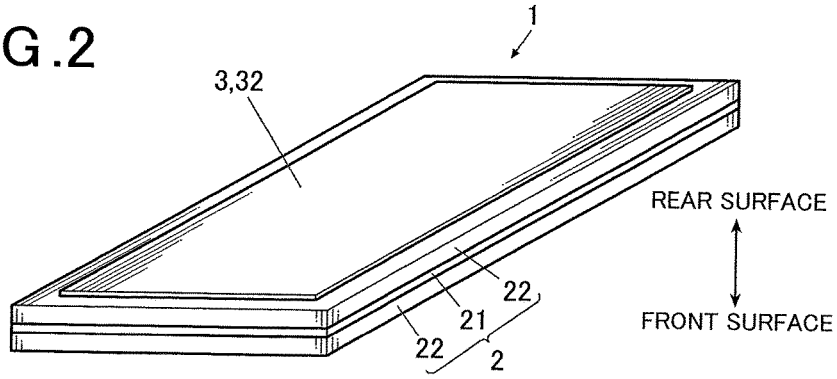
FIG. 2 is a rear perspective view of the dielectric antenna of the first embodiment.
Figure 3:
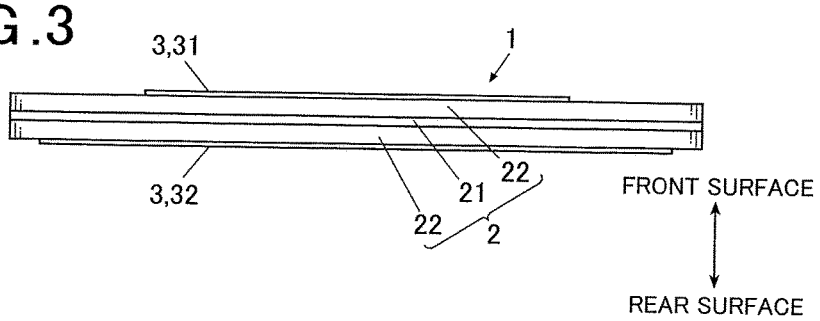
FIG. 3 is a side view of the dielectric antenna of the first embodiment.
Figure 4:
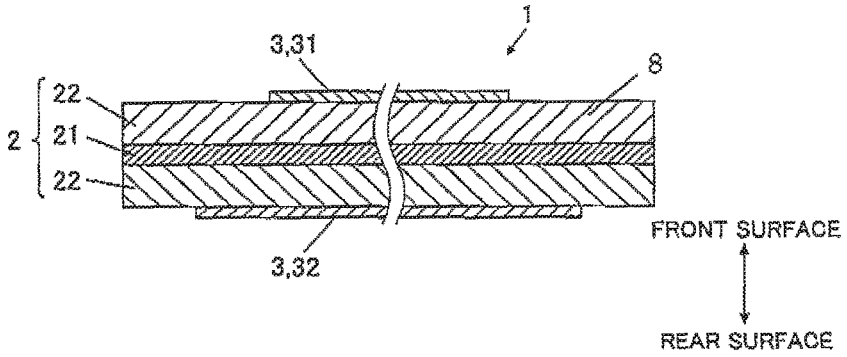
FIG. 4 is a cross-sectional view of the dielectric antenna taken from line II-II in FIG. 1.

FIGS. 1, 2, and 3 each illustrate a dielectric antenna 1 of the first embodiment; FIG. 1 is a front perspective view of the dielectric antenna 1; FIG. 2 is a rear perspective view of the dielectric antenna 1; FIG. 3 is a side view of the dielectric antenna 1; and FIG. 4 is a cross-sectional view of the dielectric antenna 1 taken from line II-II in FIG. 1.

The dielectric antenna 1 of the first embodiment is mounted on a portable device (not shown) to transmit and receive radio waves with a predetermined frequency. With reference to FIGS. 1, 2, 3, and 4, the dielectric antenna 1 includes a dielectric member 2 and two electrodes 3.

The dielectric member 2 is a rectangular laminate of a plate substrate 21 and first and second dielectric layers (flexible dielectric portions) 22 disposed on the front and rear main surfaces of the substrate 21, respectively.

The substrate 21 supports these two dielectric layers 22 and is composed of a high hardness resin. It should be noted that the substrate 21 has a higher hardness than the dielectric layers 22. The substrate 21 is preferably composed of a non-conductive resin.

Each of the dielectric layers 22 is made of a highly dielectric and flexible elastomeric composition, for example, a resin or rubber, containing highly dielectric ceramic particles 8, such as a titanic acid compound and other compounds, dispersed therein. The dielectric layers 22 are integrally laminated over the entire front and rear main surfaces, respectively, of the substrate 21, by insert molding, two-color molding, or bonding, for example.

The entire dielectric member 2 including such dielectric layers 22 has a predetermined dielectric constant, a dielectric loss tangent less than a predetermined level, and high impact resistance.

The two electrodes 3 are respectively disposed on the front and rear main surfaces of the dielectric member 2. One electrode 3 disposed on the front surface of the dielectric member 2 (or the main surface of the first dielectric layer 22) is referred to as a radiation or feed electrode 31, and the other electrode 3 disposed on the rear surface of the dielectric member 2 (or the main surface of the second dielectric layer 22) is referred to as a ground electrode 32. The radiation electrode 31 extends over a predetermined area of the substantially central portion of the front surface except the periphery of the dielectric member 2. The ground electrode extends over the substantially entire area of the rear surface of the dielectric member 2.

In this embodiment, each electrode 3 is a flat electrode made of printed silver paste; instead, the electrodes 3 may be formed by bonding or insert molding of metal plates, or plating or depositing metallic films. The electrodes 3 may be formed in a predetermined pattern.

Each of the electrodes 3 is electrically connected to the circuit board in the device body via a soldered junction or a connection terminal (not depicted). The connection terminal or any other means is preferred to the soldered junction to establish the electrical connection, because the soldering process with heat may soften and alter the dielectric layers 22 composed of an elastomer.

As described above, the dielectric member 2 of the dielectric antenna 1 of the first embodiment is configured by making the flexible dielectric layers 22 containing dispersed dielectric ceramic particles 8 laminated on the substrate 21 having higher hardness than the dielectric layers 22.

Such a dielectric member 2 thus has higher resistance to deformation than a traditional dielectric member composed of only an elastomeric member, while maintaining high dielectric constant, high impact resistance, and further high receiving sensitivity.

The dielectric member 2 is not necessarily provided with the two dielectric layers 22; instead, the dielectric member 2 may be a laminate of the substrate 21 and at least one dielectric layer 22.

The substrate 21 and the dielectric layers 22 may be laminated each other to have an area (areal range in plan view) different from each other. For example, the dielectric layers 22 may have a larger area than the substrate 21 in plan view and vice versa, with the proviso that the substrate 21 preferably has a larger area than the two electrodes 3 in plan view so as to cover the area of the electrodes 3.

Like the dielectric layers 22, the substrate 21 may contain dielectric ceramic particles to have an enhanced dielectric constant. A resin member containing a greater amount of the dielectric ceramic particles as a filler generally has lower impact resistance; therefore, the amount of the dielectric ceramic particles in the substrate 21 is preferably controlled at a low level not to impair the function of the substrate 21 as a support for the dielectric layers 22.

Second Embodiment

A second embodiment of the present invention will now be described.

The second embodiment is different from the first embodiment in the configuration of the substrate of the dielectric member. The following description is focused on the difference. The same components as those of the first embodiment are designated by the same reference numerals without the redundant description of these components.

Figure 5:
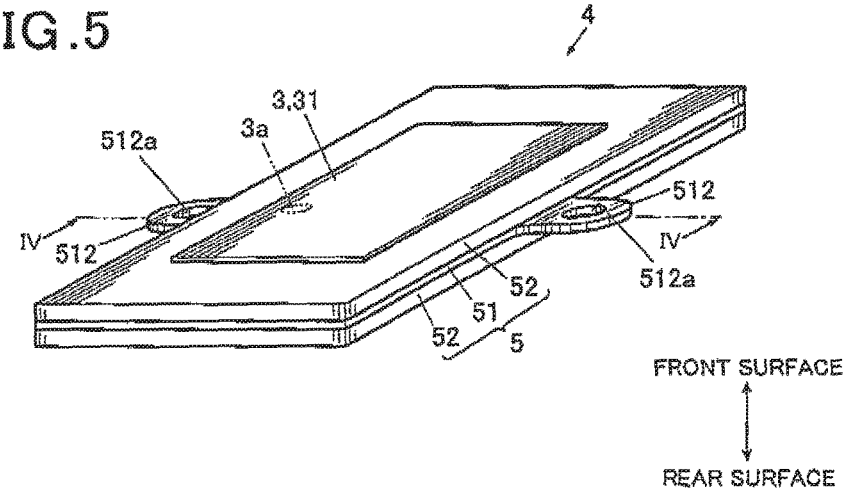
FIG. 5 is a front perspective view of a dielectric antenna of a second embodiment.
Figure 6:
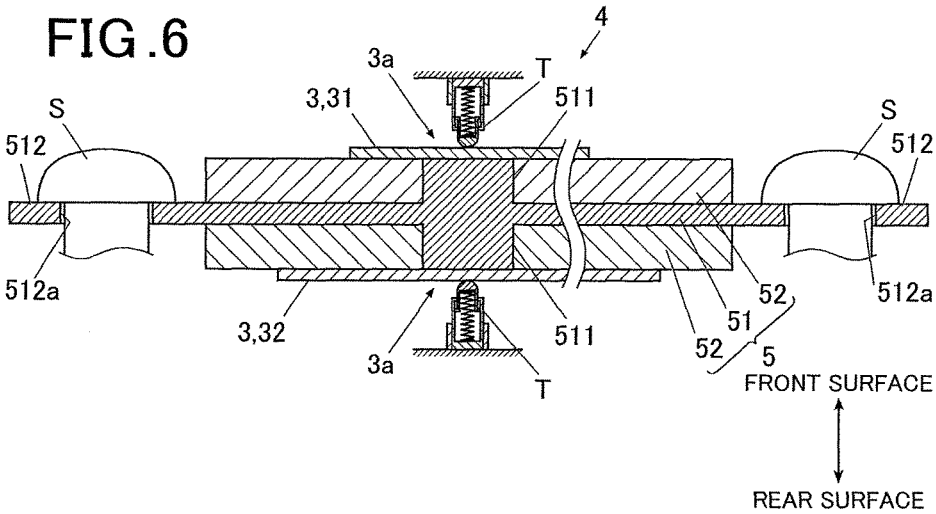
FIG. 6 is a cross-sectional view of the dielectric antenna taken from line IV-IV in FIG. 5.

FIG. 5 is a front perspective view of a dielectric antenna 4 of the second embodiment. FIG. 6 is a cross-sectional view the dielectric antenna 4 taken from line IV-IV in FIG. 5.

With reference to FIGS. 5 and 6, the dielectric antenna 4 of the second embodiment includes a dielectric member 5 in place of the dielectric member 2 of the first embodiment. The dielectric member 5 is provided with two electrodes 3.

Each of the electrodes 3 of the dielectric antenna 4 is electrically connected, at a connecting position 3*a*, to a corresponding connection terminal T disposed on the device body. The connecting positions 3*a* reside on the substantially identical line, as illustrated in FIG. 6. The two connection terminals T are disposed so as to sandwich the dielectric antenna 4 in the thickness direction of the dielectric antenna 4. Each of the connection terminals T has an urging mechanism including a spring. The two connection terminals T urge the dielectric antenna 4 in the thickness direction so as to be brought into contact with and be electrically connected to the respective electrodes 3.

The dielectric member 5 is a substantially rectangular laminate of a substantially planar substrate 51 and first and second dielectric layers 52 disposed on the front and rear main surfaces of the substrate 51, respectively.

Like the substrate 21 of the first embodiment, the substrate 51 is a support composed of a high hardness resin. The substrate 51 has upward and downward columnar protrusions 511 disposed on its front and rear main surfaces, respectively. The upward and downward protrusions 511 extend toward the first and second dielectric layers 52, respectively. The protrusions 511 are disposed on the vertical line extending through the connecting positions 3*a* on the electrodes 3, as illustrated in FIG. 6. Each of the protrusions 511 supports, on the rear surfaces of the electrodes 3, part of the electrode 3 urged with the connection terminal T. The protrusions 511 thereby prevent the deformation of the dielectric member 5 caused by the urging force of the connection terminals T.

The substrate 51 also has two fixing portions 512 extending in the longitudinal direction of the dielectric member 5. Each of the fixing portions 512 has a through hole 512*a* extending across the thickness of the fixing portions 512. Screws S extending through the through holes 512*a* fix the dielectric antenna 4 to the device body at a predetermined position. The fixing portions 512 are disposed at a part of the substrate 51 on which the dielectric layers 52 are not laminated and on which the electrodes 3 are not disposed.

The other configuration of the substrate 51 is the same as that of the substrate 21 of the first embodiment.

Like the dielectric layers 22 of the first embodiment, the first and second dielectric layers 52 are composed of a highly dielectric and elastomeric composition and are integrally laminated on the respective front and rear main surfaces of the substrate 51, other than the two protrusions 511 and the two fixing portions 512. The first and second dielectric layers 52 have substantially the same height as the upward and downward protrusions 511 so as to be substantially flush with the upward and downward protrusions 511 at the front and rear surfaces of the dielectric member 5, respectively. Part of each electrode 3 at the connecting position 3*a* is thus disposed not on the dielectric layer 52 but directly on the protrusion 511 of the substrate 51.

The other configurations of the two dielectric layers 52 are the same as those of the two dielectric layers 22 of the first embodiment described above.

As described above, the dielectric antenna 4 of the second embodiment can provide the same advantageous effect as the dielectric antenna 1 of the first embodiment.

In detail, the dielectric member 5 is configured by making the flexible dielectric layers 52 containing dispersed dielectric ceramic particles laminated on the substrate 21 having higher hardness than the dielectric layers 52. Such a dielectric member 5 thus can have higher resistance to deformation than a traditional dielectric member composed of only an elastomeric member, while maintaining high dielectric constant and high impact resistance, and can further maintain high receiving sensitivity.

The substrate 51 has upward and downward protrusions 511 disposed on the vertical line extending through the connecting positions 3*a* on the electrode 3 and extending toward the first and second dielectric layers 52, respectively, as illustrated in FIG. 6.

Each of the protrusions 511 of the substrate 51 supports, on the rear surface of the electrode 3, part of the electrode 3 urged with the connection terminal T. The protrusions 511 can prevent the deformation of the dielectric member 5 caused by the urging force of the connection terminals T.

The substrate 51 has the fixing portions 512 for fixing the dielectric antenna 4. The fixing portions 512 are not laminated with the dielectric layers 52 and the electrodes 3.

Such fixing portions 512 facilitate the fixing of the dielectric antenna 4 to the device body.

Figure 7:
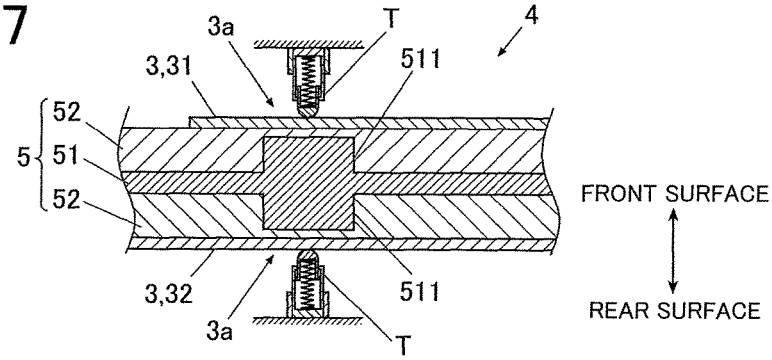
FIG. 7 is a cross-sectional view of a modification of the dielectric antenna of the second embodiment.

The upward and downward protrusions 511 of the substrate 51 may not necessarily have substantially the same height as the respective first and second dielectric layer 52, and may extend to the vicinity of the front and rear surfaces of the dielectric member 5 on which the electrodes 3 are disposed. In other words, as illustrated in FIG. 7, the first and second dielectric layers 52 may have a greater height than the upward and downward protrusions 511 so as to surround the upward and downward protrusions 511, respectively. In addition, the upward and downward protrusions 511 may be disposed at different positions each other in cross-sectional view, depending on the positions of the front and rear connection terminals T (not depicted).

Alternatively, radiation connection and ground connection may be established on one of the front and rear surfaces of the dielectric antenna 4 by so-called capacitive coupling.

Figure 8:
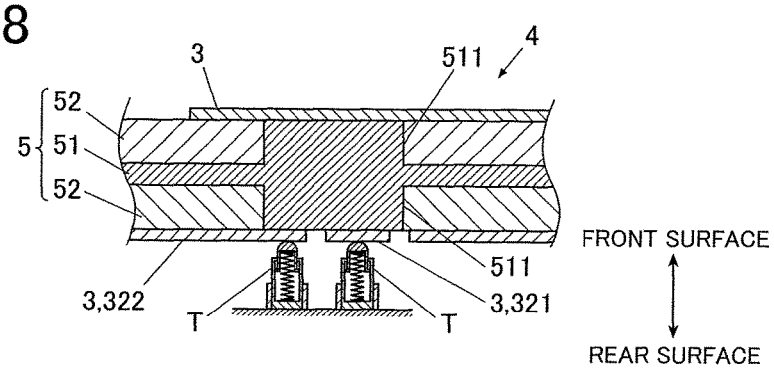
FIG. 8 is a cross-sectional view of another modification of the dielectric antenna of the second embodiment.

In detail, these two connections are established on the rear surface of the dielectric antenna 4, as illustrated in FIG. 8, for example. The electrode 3 on the rear surface of the dielectric antenna 4 is partially separated, and the entire separated portion of the electrodes 3 resides within the region of the downward protrusion 511. The separated portion of the electrode 3 is referred to as a radiation electrode 321, and the remaining portion of the electrode 3 is referred to as a ground electrode 322. The radiation electrode 321 is connected to the feed connection terminal T, and the ground electrode 322 is connected to the ground connection terminal T. In this case, the upward and downward protrusions 511 preferably have appropriately large dimensions to allow the two connection terminals T to be in contact with the radiation electrode 321 and the ground electrode 322, respectively, within the respective regions of the downward protrusions 511.

Alternatively, the upward or downward protrusion 511 not urged with the connection terminals T (i.e., the upward protrusion 511 in FIG. 8) may be removed.

In the second embodiment, the dielectric antenna 4 is fixed to the device body with the screws S extending through the fixing portions 512 of the substrate 51. The dielectric antenna 4 may be fixed to the device body with any means other than the screws, and may be fixed with a double-sided adhesive tape, for example.

Third Embodiment

A third embodiment of the present invention will now be described.

The third embodiment is different from the first and second embodiments in the configuration of the substrate of the dielectric member. The following description is focused on the difference. The same components as those of the first and second embodiments are designated by the same reference numerals without the redundant description of these components.

Figure 9:
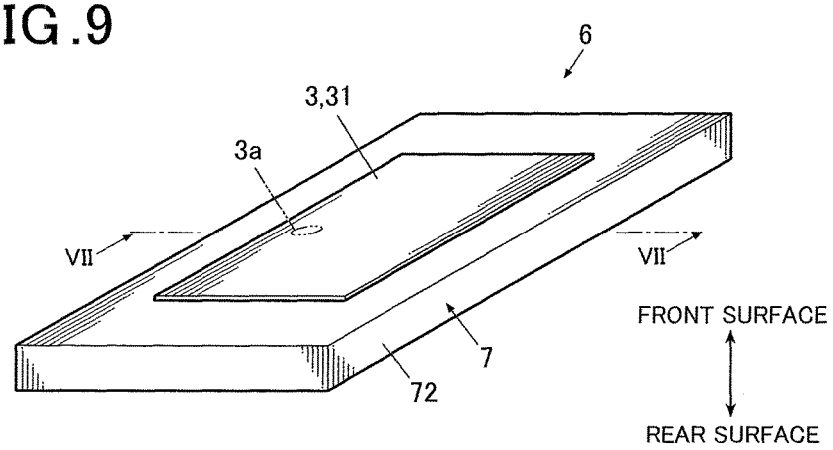
FIG. 9 is a front perspective view of a dielectric antenna of a third embodiment.
Figure 10:
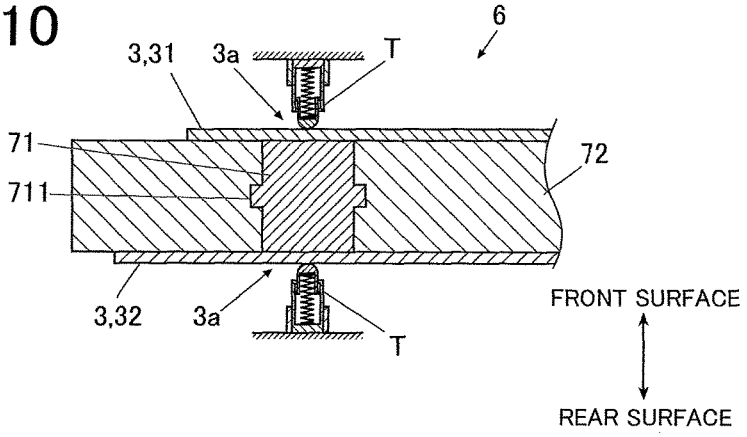
FIG. 10 is a cross-sectional view of the dielectric antenna taken from line VII-VII in FIG. 9.

FIG. 9 is a front perspective view of the dielectric antenna 6 of the third embodiment, FIG. 10 is a cross-sectional view of the dielectric antenna 6 taken from line VII-VII in FIG. 9.

With reference to FIGS. 9 and 10, the dielectric antenna 6 of the third embodiment includes a dielectric member 7 in place of the dielectric member 5 of the second embodiment. The dielectric member 7 is provided with two electrodes 3.

As in the dielectric antenna 4 of the second embodiment, each of the electrodes 3 of the dielectric antenna 6 is electrically connected, at a connecting position 3*a*, to a corresponding connection terminal T disposed on the device body. The connecting positions 3*a* reside on substantially the same vertical line, as illustrated in FIG. 10. Each of the connection terminals T has an urging mechanism.

The dielectric member 7 is a rectangular plate composed of a substrate 71 and a dielectric layer 72.

Like the substrate 21 of the first embodiment, the substrate 71 is a support composed of a high hardness resin. The substrate 71 is a substantial column extending along the thickness of the dielectric member 7. As illustrated in FIG. 10, the substrate 71 of the dielectric member 7 is disposed on the vertical line extending through the connecting positions 3*a* on the electrodes 3. The substrate 71 has a similar configuration to the two protrusions 511 of the substrate 51 of the second embodiment. The substrate 71 supports, on the rear surfaces of the electrodes 3, parts of the electrodes 3 urged with the connection terminals T, to prevent the deformation of the dielectric antenna 6 caused by the urging force of the connection terminals T.

The substrate 71 has a projection 711 disposed at the substantial middle of its height and extending along the entire circumference of the substrate 71. The projection 711 can tightly connect the substrate 71 to the dielectric layer 72, and thereby prevent the detachment of the substrate 71 from the dielectric layer 72.

Like the dielectric layers 22 of the first embodiment, the dielectric layer 72 is composed of a highly dielectric elastomeric composition, and is part of the dielectric member 7 other than the substrate 71 (i.e., is disposed in the region not including the connecting positions 3*a* of the electrodes 3, as illustrated in FIG. 10). The dielectric layer 72 is integrated with the substrate 71 by insert molding, two-color molding, or bonding. The dielectric layer 72 has substantially the same height as the substrate 71 so as to be substantially flush with the substrate 71 at the front and rear surface of the dielectric member 7. Parts of the electrodes 3 at the connecting positions 3*a* are thus disposed not on the dielectric layer 72 but directly on the substrate 71.

As described above, the substrate 71 of the dielectric antenna 6 of the third embodiment supports, on the rear surfaces of the electrodes 3, part of the electrodes 3 disposed on the vertical line extending through the connecting positions 3*a* urged with the connection terminals T in cross-sectional view. Such a configuration can prevent the deformation of the dielectric member 7 caused by the urging force of the connection terminals T.

Such a dielectric member 7 including the flexible dielectric layer 72 containing dispersed dielectric ceramic particles can have high dielectric constant and high impact resistance, and can further maintain high receiving sensitivity.

In the third embodiment, the substrate 71 supports only parts, which are urged with the connection terminals T, of the electrodes 3. The substrate 71 may also have a supporting portion for the dielectric layer 72.

Figure 11:
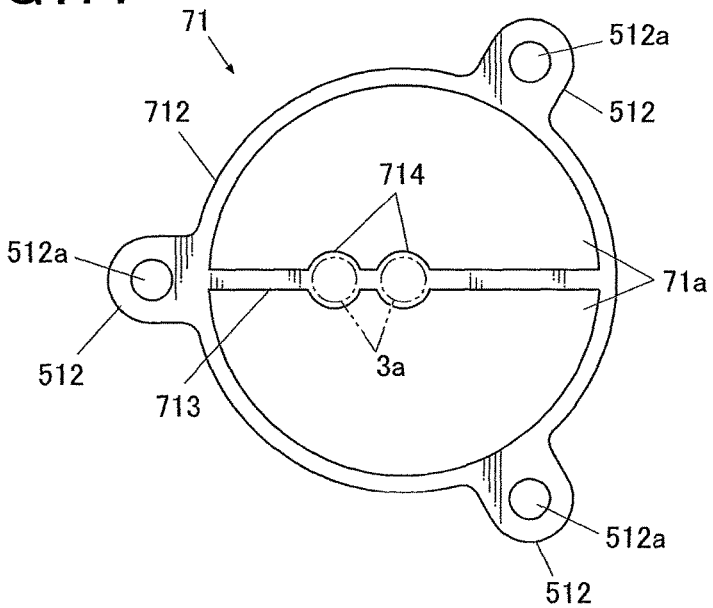
FIG. 11 is a front view of a modification of the substrate of the dielectric antenna of the third embodiment.
Figure 12:
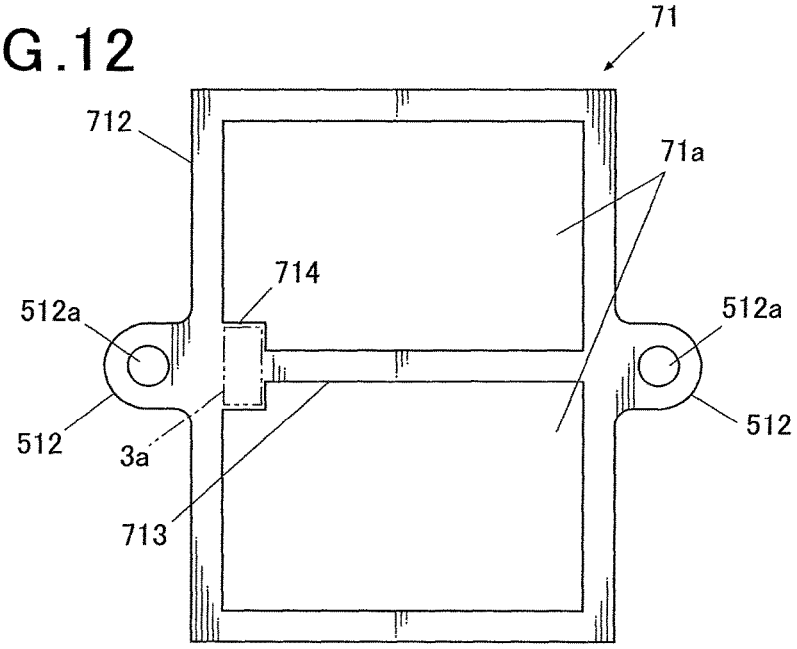
FIG. 12 is a front view of another modification of the substrate of the dielectric antenna of the third embodiment.

For example, with reference to FIGS. 11 and 12, the substrate 71 is composed of a frame 712 and a bridge 713. The frame 712 has a shape conforming to the external shape of the dielectric layer 72 or the dielectric member 7 having a circular top view in FIG. 11, or a rectangular top view in FIG. 12. The bridge 713 extends across the opposite sides of the frame 712 through electrode supporting portions 714. The electrode supporting portions 714 are disposed at positions corresponding to the connecting positions 3*a* on the electrodes 3. The dielectric layer 72 is disposed in the internal space 71*a* surrounded by the frame 712. The outer surface of the dielectric layer 72 is supported by the frame 712 and the bridge 713. The frame 712 may have optional fixing portions 512 as in the second embodiment.

Such a substrate 71 can prevent the deformation of the dielectric member 7 caused by the urging force of the connection terminals T while appropriately supporting the dielectric layer 72.

It should be understood that the present invention is not limited to the first to third embodiments described above, and may be variously modified within the gist of the present invention.

The embodiments of the present invention, which have been described, should not be construed to limit the scope of the present invention and should include the scope of the appended claims and the scope of all equivalents thereof.

What is claimed is:

1. A dielectric antenna comprising:

a dielectric member comprising a first dielectric layer, a second dielectric layer, and a substrate, wherein the substrate is positioned between the first and second dielectric layers and has higher hardness than the first and second dielectric layers;

a first electrode disposed on the first dielectric layer; and a second electrode disposed on the second dielectric layer;

wherein ceramic particles are dispersed in the first and second dielectric layers;

wherein the substrate comprises a first protrusion which projects into the first dielectric layer toward a connecting position of the first electrode to be contacted by a first connection terminal; and wherein the substrate comprises a second protrusion which projects into the second dielectric layer toward a connecting position of the second electrode to be contacted by a second connection terminal.

2. The dielectric antenna according to claim 1, wherein part of the first dielectric layer is disposed between the first protrusion and the first electrode; and wherein part of the second dielectric layer is disposed between the second protrusion and the second electrode.

3. The dielectric antenna according to claim 2, wherein the first protrusion contacts the first electrode; and wherein the second protrusion contacts the second electrode.

4. The dielectric antenna according to claim 1, wherein the first and second dielectric layers comprise resin or rubber.

5. The dielectric antenna according to claim 1, wherein the substrate comprises a fixing portion to fix the dielectric antenna, the fixing portion being disposed at a part of the substrate on which the first and second dielectric layers are not provided and the first and second electrodes are not disposed.

6. The dielectric antenna according to claim 1, wherein the substrate comprises a resin.

* * * * *